US008392178B2

(12) United States Patent
Vos

(10) Patent No.: US 8,392,178 B2
(45) Date of Patent: Mar. 5, 2013

(54) PITCH LAG VECTORS FOR SPEECH ENCODING

(75) Inventor: Koen Bernard Vos, San Francisco, CA (US)

(73) Assignee: Skype, Dublin (IE)

( * ) Notice: Subject to any disclaimer, the term of this patent is extended or adjusted under 35 U.S.C. 154(b) by 850 days.

(21) Appl. No.: 12/455,712

(22) Filed: Jun. 5, 2009

(65) Prior Publication Data

US 2010/0174534 A1 Jul. 8, 2010

(30) Foreign Application Priority Data

Jan. 6, 2009 (GB) ..... 0900139.7

(51) Int. Cl.
*G10L 11/04* (2006.01)
*G10L 19/00* (2006.01)

(52) U.S. Cl. ..... 704/207; 704/222

(58) Field of Classification Search ..... None
See application file for complete search history.

(56) References Cited

U.S. PATENT DOCUMENTS

| | | | |
|---|---|---|---|
| 4,857,927 | A | 8/1989 | Takabayashi |
| 5,125,030 | A | 6/1992 | Nomura et al. |
| 5,240,386 | A | 8/1993 | Amin et al. |
| 5,253,269 | A | 10/1993 | Gerson et al. |
| 5,327,250 | A | 7/1994 | Ikeda |
| 5,357,252 | A | 10/1994 | Ledzius et al. |
| 5,487,086 | A | 1/1996 | Bhaskar |
| 5,646,961 | A | 7/1997 | Shoham et al. |
| 5,649,054 | A | 7/1997 | Oomen et al. |
| 5,680,508 | A | 10/1997 | Liu |
| 5,699,382 | A | 12/1997 | Shoham et al. |
| 5,774,842 | A | 6/1998 | Nishio et al. |
| 5,867,814 | A | 2/1999 | Yong |
| 6,104,992 | A | 8/2000 | Gao et al. |
| 6,122,608 | A | 9/2000 | McCree |
| 6,173,257 | B1 | 1/2001 | Gao |
| 6,188,980 | B1 | 2/2001 | Thyssen |
| 6,260,010 | B1 | 7/2001 | Gao et al. |
| 6,363,119 | B1 | 3/2002 | Oami |
| 6,408,268 | B1 | 6/2002 | Tasaki |
| 6,456,964 | B2 | 9/2002 | Manjunath et al. |

(Continued)

FOREIGN PATENT DOCUMENTS

| | | |
|---|---|---|
| EP | 0501421 | 9/1992 |
| EP | 0550990 | 7/1993 |

(Continued)

OTHER PUBLICATIONS

"Coding of Speech at 8 kbit/s Using Conjugate-Structure Algebraic-Code-Excited Linear-Prediction (CS-ACELP)", *International Telecommunication Union, ITUT*, (1996), 39 pages.

(Continued)

*Primary Examiner* — Talivaldis Ivars Smits
(74) *Attorney, Agent, or Firm* — Wolfe-SBMC

(57) ABSTRACT

A method of encoding speech, the method comprising: receiving a signal representative of speech to be encoded; at each of a plurality of intervals during the encoding, determining a pitch lag between portions of the signal having a degree of repetition; selecting for a set of said intervals a pitch lag vector from a pitch lag codebook of such vectors, each pitch lag vector comprising a set of offsets corresponding to the offset between the pitch lag determined for each said interval and an average pitch lag for said set of intervals, and transmitting an indication of the selected vector and said average over a transmission medium as part of the encoded signal representative of said speech.

19 Claims, 7 Drawing Sheets

302

| Index | Vector |
|---|---|
| 1 | $C_1=(O_{1,1}, O_{1,2}, \ldots O_{1,i})$ |
| 2 | $C_2=(O_{2,1}, O_{2,2}, \ldots O_{2,i})$ |
| ⋮ | ⋮ |
| M | $C_M=(O_{M,1}, O_{M,2}, \ldots O_{M,i})$ |

U.S. PATENT DOCUMENTS

| | | | |
|---|---|---|---|
| 6,470,309 | B1 | 10/2002 | McCree |
| 6,493,665 | B1 | 12/2002 | Su et al. |
| 6,502,069 | B1 | 12/2002 | Grill et al. |
| 6,523,002 | B1 | 2/2003 | Gao et al. |
| 6,574,593 | B1 | 6/2003 | Gao et al. |
| 6,751,587 | B2 | 6/2004 | Thyssen et al. |
| 6,757,649 | B1 | 6/2004 | Gao et al. |
| 6,757,654 | B1 | 6/2004 | Westerlund et al. |
| 6,775,649 | B1 | 8/2004 | DeMartin |
| 6,862,567 | B1 | 3/2005 | Gao |
| 6,996,523 | B1 | 2/2006 | Bhaskar et al. |
| 7,136,812 | B2 | 11/2006 | Manjunath et al. |
| 7,149,683 | B2 | 12/2006 | Jelinek |
| 7,151,802 | B1 | 12/2006 | Bessette et al. |
| 7,171,355 | B1 | 1/2007 | Chen |
| 7,496,505 | B2 | 2/2009 | Manjunath et al. |
| 7,505,594 | B2 | 3/2009 | Mauro |
| 7,684,981 | B2 | 3/2010 | Thumpudi et al. |
| 7,869,993 | B2 | 1/2011 | Ojala |
| 7,873,511 | B2 | 1/2011 | Herre et al. |
| 8,036,887 | B2 | 10/2011 | Yasunaga et al. |
| 8,069,040 | B2 | 11/2011 | Vos |
| 8,078,474 | B2 | 12/2011 | Vos et al. |
| 2001/0001320 | A1 | 5/2001 | Heinen et al. |
| 2001/0005822 | A1 | 6/2001 | Fujii et al. |
| 2001/0039491 | A1 | 11/2001 | Yasunaga et al. |
| 2002/0032571 | A1 | 3/2002 | Leung et al. |
| 2002/0099540 | A1 | 7/2002 | Yasunaga et al. |
| 2002/0120438 | A1 | 8/2002 | Lin |
| 2003/0200092 | A1 | 10/2003 | Gao et al. |
| 2004/0102969 | A1 | 5/2004 | Manjunath et al. |
| 2005/0141721 | A1 | 6/2005 | Aarts et al. |
| 2005/0278169 | A1 | 12/2005 | Hardwick |
| 2005/0285765 | A1 | 12/2005 | Suzuki et al. |
| 2006/0074643 | A1 | 4/2006 | Lee et al. |
| 2006/0235682 | A1 | 10/2006 | Yasunaga et al. |
| 2006/0271356 | A1 | 11/2006 | Vos |
| 2007/0043560 | A1 | 2/2007 | Lee |
| 2007/0055503 | A1 | 3/2007 | Chu et al. |
| 2007/0088543 | A1 | 4/2007 | Ehara |
| 2007/0100613 | A1 | 5/2007 | Yasunaga et al. |
| 2007/0136057 | A1 | 6/2007 | Phillips |
| 2007/0225971 | A1 | 9/2007 | Bessette |
| 2007/0255561 | A1 | 11/2007 | Su et al. |
| 2008/0004869 | A1 | 1/2008 | Herre et al. |
| 2008/0015866 | A1 | 1/2008 | Thyssen et al. |
| 2008/0126084 | A1 | 5/2008 | Lee et al. |
| 2008/0140426 | A1 | 6/2008 | Kim et al. |
| 2008/0154588 | A1 | 6/2008 | Gao |
| 2008/0275698 | A1 | 11/2008 | Yasunaga et al. |
| 2009/0043574 | A1 | 2/2009 | Gao et al. |
| 2009/0222273 | A1 | 9/2009 | Massaloux et al. |
| 2010/0174531 | A1 | 7/2010 | Bernard Vos |
| 2010/0174532 | A1 | 7/2010 | Vos et al. |
| 2010/0174547 | A1 | 7/2010 | Vos |
| 2011/0077940 | A1 | 3/2011 | Vos et al. |
| 2011/0173004 | A1 | 7/2011 | Bessette et al. |

FOREIGN PATENT DOCUMENTS

| | | | |
|---|---|---|---|
| EP | 0610906 | | 8/1994 |
| EP | 0 720 145 | A2 | 7/1996 |
| EP | 0724252 | | 7/1996 |
| EP | 0849724 | | 6/1998 |
| EP | 0 877 355 | A2 | 11/1998 |
| EP | 0 957 472 | A2 | 11/1999 |
| EP | 1 093 116 | A1 | 4/2001 |
| EP | 1255244 | | 11/2002 |
| EP | 1326235 | | 7/2003 |
| EP | 1758101 | | 2/2007 |
| EP | 1903558 | | 3/2008 |
| GB | 2466669 | | 7/2010 |
| GB | 2466670 | | 7/2010 |
| GB | 2466671 | | 7/2010 |
| GB | 2466672 | | 7/2010 |
| GB | 2466673 | | 7/2010 |
| GB | 2466674 | | 7/2010 |
| GB | 2466675 | | 7/2010 |
| JP | 1205638 | | 10/1987 |
| JP | 2287400 | | 4/1989 |
| JP | 4312000 | | 4/1991 |
| JP | 7306699 | | 5/1994 |
| JP | 2007-279754 | | 10/2007 |
| WO | WO-9103790 | | 3/1991 |
| WO | WO-9403988 | | 2/1994 |
| WO | WO-9518523 | | 7/1995 |
| WO | WO-9918565 | | 4/1999 |
| WO | WO-9963521 | | 12/1999 |
| WO | WO-0103122 | | 1/2001 |
| WO | WO-0191112 | | 11/2001 |
| WO | WO-03052744 | | 6/2003 |
| WO | WO-2005009019 | | 1/2005 |
| WO | WO-2008046492 | | 4/2008 |
| WO | WO-2008056775 | | 5/2008 |
| WO | WO-2010079163 | | 7/2010 |
| WO | WO-2010079164 | | 7/2010 |
| WO | WO-2010079165 | | 7/2010 |
| WO | WO-2010079166 | | 7/2010 |
| WO | WO-2010079167 | | 7/2010 |
| WO | WO-2010079170 | | 7/2010 |
| WO | WO-2010079171 | | 7/2010 |

OTHER PUBLICATIONS

"International Search Report and Written Opinion", Application No. PCT/EP2010/050060, (Apr. 14, 2010), 14 pages.

"International Search Report and Written Opinion", Application No. PCT/EP2010/050052, (Jun. 21, 2010), 13 pages.

"International Search Report and Written Opinion", Application No. PCT/EP2010/050057, (Jun. 24, 2010), 11 pages.

"International Search Report and Written Opinion", Application No. PCT/EP2010/050053, (May 17, 2010), 17 pages.

"International Search Report and Written Opinion", Application No. PCT/EP2010/050061, (Apr. 12, 2010), 13 pages.

"International Search Report and Written Opinion", Application No. PCT/EP2010/050056, (Mar. 29, 2010), 8 pages.

"Non-Final Office Action", U.S. Appl. No. 12/455,632, (Feb. 6, 2012), 18 pages.

"Non-Final Office Action", U.S. Appl. No. 12/586,915, (May 8, 2012), 10 pages.

"Notice of Allowance", U.S. Appl. No. 12/455,632, (May 15, 2012), 7 pages.

"Search Report", Application No. GB 0900141.3, (Apr. 30, 2009), 3 pages.

"Search Report", Application No. GB 0900142.1, (Apr. 21, 2009), 2 pages.

"Search Report", Application No. GB 0900144.7, (Apr. 24, 2009), 2 pages.

"Search Report", Application No. GB0900143.9, (Apr. 28, 2009), 1 page.

"Search Report", Application No. GB0900145.4, (Apr. 27, 2009), 1 page.

"Wideband Coding of Speech at Around 1 kbit/sUsing Adaptive Multi-rate Wideband (AMR-WB)", *International Telecommunication Union G.722.2*, (2002), pp. 1-65.

Bishnu, S et al., "Predictive Coding of Speech Signals and Error Criteria", *IEEE, Transactions on Avoustics, Speech and Signal Processing, ASSP* 27(3), (1979), pp. 247-254.

Chen, Juin-Hwey "Novel Codec Structures for Noise Feedback Coding of Speech", *IEEE*, (2006), pp. 681-684.

Chen, L "Subframe Interpolation Optimized Coding of LSF Parameters", *IEEE*, (Jul. 2007), pp. 725-728.

Denckla, Ben "Subtractive Dither for Internet Audio", *Journal of the Audio Engineering Society*, vol. 46, Issue 7/8, (Jul. 1998), pp. 654-656.

Ferreira, C R., et al., "Modified Interpolation of LSFs Based on Optimization of Distortion Measures", *IEEE*, (Sep. 2006), pp. 777-782.

Gerzon, et al., "A High-Rate Buried-Data Channel for Audio CD", Journal of Audio Engineering Society, vol. 43, No. 1/2,(Jan. 1995), 22 pages.

Islam, T et al., "Partial-Energy Weighted Interpolation of Linear Prediction Coefficients", *IEEE*, (Sep. 2000), pp. 105-107.

Jayant, N S., et al., "The Application of Dither to the Quantization of Speech Signals", *Program of the 84th Meeting of the Acoustical Society of America*. (*Abstract Only*), (Nov.-Dec. 1972), pp. 1293-1304.
Lupini, Peter et al., "A Multi-Mode Variable Rate Celp Coder Based on Frame Classification", *Proceedings of the International Conference on Communications* (*ICC*), *IEEE 1*, (1993), pp. 406-409.
Mahe, G et al., "Quantization Noise Spectral Shaping in Instantaneous Coding of Spectrally Unbalanced Speech Signals", *IEEE, Speech Coding Workshop*, (2002), pp. 56-58.
Makhoul, John et al., "Adaptive Noise Spectral Shaping and Entropy Coding of Speech", (Feb. 1979), pp. 63-73.
Martins Da Silva, L et al., "Interpolation-Based Differential Vector Coding of Speech LSF Parameters", *IEEE*, (Nov. 1996), pp. 2049-2052.
Salami, R "Design and Description of CS-ACELP: A Toll Quality 8 kb/s Speech Coder", *IEEE*, 6(2), (Mar. 1998), pp. 116-130.
Haagen, J., et al., "Improvements in 2.4 KBPS High-Quality Speech Coding," *IEEE*, 2:145-148, (Mar. 1992).
Rao, A.V., et al., "Pitch Adaptive Windows for Improved Excitation Coding in Low-Rate CELP Coders," *IEEE Transactions on Speech and Audio Processing*, 11(6):648-659, (Nov. 2003).
International Search Report from PCT/EP2010/050051, 5 pp., mailed Mar. 15, 2010.
Written Opinion of the International Searching Authority, 8 pp., from PCT/EP2010/050051, mailed Mar. 15, 2010.
Search Report of GB 0900139.7, date of mailing Apr. 17, 2009.
"Final Office Action", U.S. Appl. No. 12/455,478, (Jun. 28, 2012), 8 pages.
"Foreign Office Action", Great Britain Application No. 0900145.4, (May 28, 2012), 2 pages.
"Non-Final Office Action", U.S. Appl. No. 12/455,100, (Jun. 8, 2012), 8 pages.
"Non-Final Office Action", U.S. Appl. No. 12/455,157, (Aug. 6, 2012), 15 pages.
"Non-Final Office Action", U.S. Appl. No. 12/455,632, (Oct. 18, 2011), 14 pages.
"Non-Final Office Action", U.S. Appl. No. 12/455,632, (Aug. 22, 2012), 14 pages.
"Non-Final Office Action", U.S. Appl. No. 12/455,752, (Jun. 15, 2012), 8 pages.
"Final Office Action", U.S. Appl. No. 12/455,100, (Oct. 4, 2012), 5 pages.
"Final Office Action", U.S. Appl. No. 12/455,752, (Nov. 23, 2012), 8 pages.
"Non-Final Office Action", U.S. Appl. No. 12/583,998, (Oct. 18, 2012), 16 pages.
"Non-Final Office Action", U.S. Appl. No. 12/586,915, (Sep. 25, 2012), 10 pages.
"Notice of Allowance", U.S. Appl. No. 12/455,157, (Nov. 29, 2012), 9 pages.
"Examination Report", GB Application No. 0900141.3, (Oct. 8, 2012), 2 pages.
"Notice of Allowance", U.S. Appl. No. 12/455,478, (Dec. 7, 2012), 7 pages.
"Examination Report", GB Application No. 0900140.5, (Aug. 29, 2012), 3 pages.
"Search Report", GB Application No. 0900140.5, (May 5, 2009), 3 pages.
"Final Office Action", U.S. Appl. No. 12/455,632, (Jan. 18, 2013), 15 pages.
"Notice of Allowance", U.S. Appl. No. 12/586,915, (Jan. 22, 2013), 8 pages.
"Supplemental Notice of Allowance", U.S. Appl. No. 12/455,157, (Jan. 22, 2013), 2 pages.
"Supplemental Notice of Allowance", U.S. Appl. No. 12/455,478, (Jan. 11, 2013), 2 pages.

302

| Index | Vector |
|---|---|
| 1 | $C_1=(O_{1,1}, O_{1,2}, \ldots O_{1,i})$ |
| 2 | $C_2=(O_{2,1}, O_{2,2}, \ldots O_{2,i})$ |
| ⋮ | ⋮ |
| M | $C_M=(O_{M,1}, O_{M,2}, \ldots O_{M,i})$ |

PITCH LAG VECTORS FOR SPEECH ENCODING

RELATED APPLICATION

This application claims priority under 35 U.S.C. §119 or 365 to Great Britain Application No. 0900139.7, filed Jan. 6, 2009. The entire teachings of the above application are incorporated herein by reference.

FIELD OF THE INVENTION

The present invention relates to the encoding of speech for transmission over a transmission medium, such as by means of an electronic signal over a wired connection or electromagnetic signal over a wireless connection.

BACKGROUND

A source-filter model of speech is illustrated schematically in FIG. 1*a*. As shown, speech can be modelled as comprising a signal from a source 102 passed through a time-varying filter 104. The source signal represents the immediate vibration of the vocal chords, and the filter represents the acoustic effect of the vocal tract formed by the shape of the throat, mouth and tongue. The effect of the filter is to alter the frequency profile of the source signal so as to emphasise or diminish certain frequencies. Instead of trying to directly represent an actual waveform, speech encoding works by representing the speech using parameters of a source-filter model.

As illustrated schematically in FIG. 1*b*, the encoded signal will be divided into a plurality of frames 106, with each frame comprising a plurality of subframes 108. For example, speech may be sampled at 16 kHz and processed in frames of 20 ms, with some of the processing done in subframes of 5 ms (four subframes per frame). Each frame comprises a flag 107 by which it is classed according to its respective type. Each frame is thus classed at least as either "voiced" or "unvoiced", and unvoiced frames are encoded differently than voiced frames. Each subframe 108 then comprises a set of parameters of the source-filter model representative of the sound of the speech in that subframe.

For voiced sounds (e.g. vowel sounds), the source signal has a degree of long-term periodicity corresponding to the perceived pitch of the voice. In that case, the source signal can be modelled as comprising a quasi-periodic signal, with each period corresponding to a respective "pitch pulse" comprising a series of peaks of differing amplitudes. The source signal is said to be "quasi" periodic in that on a timescale of at least one subframe it can be taken to have a single, meaningful period which is approximately constant; but over many subframes or frames then the period and form of the signal may change. The approximated period at any given point may be referred to as the pitch lag. The pitch lag can be measured in time or as a number of samples. An example of a modelled source signal 202 is shown schematically in FIG. 2*a* with a gradually varying period $P_1$, $P_2$, $P_3$, etc., each comprising a pitch pulse of four peaks which may vary gradually in form and amplitude from one period to the next.

According to many speech coding algorithms such as those using Linear Predictive Coding (LPC), a short-term filter is used to separate out the speech signal into two separate components: (i) a signal representative of the effect of the time-varying filter 104; and (ii) the remaining signal with the effect of the filter 104 removed, which is representative of the source signal. The signal representative of the effect of the filter 104 may be referred to as the spectral envelope signal, and typically comprises a series of sets of LPC parameters describing the spectral envelope at each stage. FIG. 2*b* shows a schematic example of a sequence of spectral envelopes $\mathbf{204}_1$, $\mathbf{204}_2$, $\mathbf{204}_3$, etc. varying over time. Once the varying spectral envelope is removed, the remaining signal representative of the source alone may be referred to as the LPC residual signal, as shown schematically in FIG. 2*a*. The short-term filter works by removing short-term correlations (i.e. short term compared to the pitch period), leading to an LPC residual with less energy than the speech signal.

The spectral envelope signal and the source signal are each encoded separately for transmission. In the illustrated example, each subframe 106 would contain: (i) a set of parameters representing the spectral envelope 204; and (ii) an LPC residual signal representing the source signal 202 with the effect of the short-term correlations removed.

To improve the encoding of the source signal, its periodicity may be exploited. To do this, a long-term prediction (LTP) analysis is used to determine the correlation of the LPC residual signal with itself from one period to the next, i.e. the correlation between the LPC residual signal at the current time and the LPC residual signal after one period at the current pitch lag (correlation being a statistical measure of a degree of relationship between groups of data, in this case the degree of repetition between portions of a signal). In this context the source signal can be said to be "quasi" periodic in that on a timescale of at least one correlation calculation it can be taken to have a meaningful period which is approximately (but not exactly) constant; but over many such calculations then the period and form of the source signal may change more significantly. A set of parameters derived from this correlation are determined to at least partially represent the source signal for each subframe. The set of parameters for each subframe is typically a set of coefficients of a series, which form a respective vector.

The effect of this inter-period correlation is then removed from the LPC residual, leaving an LTP residual signal representing the source signal with the effect of the correlation between pitch periods removed. To represent the source signal, the LTP vectors and LTP residual signal are encoded separately for transmission. In the encoder, an LTP analysis filter uses one or more pitch lags with the LTP coefficients to compute the LTP residual signal from the LPC residual.

The pitch lags, the LTP vectors and the LTP residual signal are sent to the decoder together with the coded LTP residual, and used to construct the speech output signal. They are each quantised prior to transmission (quantisation being the process of converting a continuous range of values into a set of discrete values, or a larger approximately continuous set of discrete values into a smaller set of discrete values). The advantage of separating out the LPC residual signal into the LTP vectors and LTP residual signal is that the LTP residual typically has a lower energy than the LPC residual, and so requires fewer bits to quantize.

So in the illustrated example, each subframe 106 would comprise: (i) a quantised set of LPC parameters (including pitch lags) representing the spectral envelope, (ii)(a) a quantised LTP vector related to the correlation between pitch periods in the source signal, and (ii)(b) a quantised LTP residual signal representative of the source signal with the effects of this inter-period correlation removed.

In order to minimise the LTP residual it is advantageous to update the pitch lags frequently. Typically, a new pitch lag is defined every subframe of 5 or 10 ms. However, transmitting pitch lags comes at a cost in bit rate, as it typically takes 6 to 8 bits to encode one pitch lag.

One approach to reduce the cost in bit rate is to specify the pitch lags to some of the subframes relative to the lag of the preceding subframes. By not allowing lag difference to exceed a certain range, the relative lag requires fewer bits for encoding.

The restriction on lag difference however can lead to inaccurate or unnatural pitch lags which then affect speech decoding.

SUMMARY OF THE INVENTION

According to one aspect of the present invention, there is provided a method of encoding speech, the method comprising:

receiving a signal representative of speech to be encoded;

at each of a plurality of intervals during the encoding, determining a pitch lag between portions of the signal having a degree of repetition;

selecting for a set of said intervals a pitch lag vector from a pitch lag codebook of such vectors, each pitch lag vector comprising a set of offsets corresponding to the offset between the pitch lag determined for each said interval and an average pitch lag for said set of intervals, and transmitting an indication of the selected vector and said average over a transmission medium as part of the encoded signal representative of said speech.

In the preferred embodiment, speech is encoded according to a source filter model whereby speech is modelled to comprise a source signal filtered by a time varying filter. A spectral envelope signal representative of the model filter is derived from the speech signal, along with a first remaining signal representative of the modelled source signal. The pitch lag can be determined between portions of the first remaining signal having a degree of repetition.

The invention also provides an encoder for encoding speech, the encoder comprising:

means for determining at each of a plurality of intervals during the encoding of a received signal representative of speech, a pitch lag between portions of said signal having a degree of repetition;

means for selecting for a set of said intervals a pitch lag vector from a pitch lag code book of such vectors, each pitch lag vector comprising a set of offsets corresponding to the offsets between the pitch lag determined for each said interval and an average pitch lag for said set of intervals; and means for transmitting an indication of the selected vector and said average over a transmission medium as part of the encoded signal representative of said speech.

The invention further provides a method of decoding an encoded signal representative of speech, the encoded signal comprising an indication of a pitch lag vector comprising a set of offsets corresponding to an offset between a pitch lag determined for each interval in said set and an average pitch lag for said set of intervals;

determining for each interval a pitch lag based on the average pitch lag for said set of intervals and each corresponding offset in the pitch lag vector identified by the indication; and using the determined pitch lags to encode other portions of a received signal representative of said speech.

The invention further provides a decoder for decoding an encoded signal representative of speech, the decoder comprising:

means for identifying from a received indication in the encoded signal a pitch lag vector from a pitch lag codebook of such vectors; and means for determining a pitch lag for each of a set of intervals from a corresponding offset in the pitch lag vector and an average pitch lag for said set of intervals, said average pitch lag being part of the encoded signal.

The invention also provides a client application in the form of a computer program product which when executed implements an encode or decode method as hereinabove described.

BRIEF DESCRIPTION OF THE DRAWINGS

For a better understanding of the present invention and to show how it may be carried into effect, reference will now be made by way of example to the accompanying drawings in which.

DETAILED DESCRIPTION OF PREFERRED EMBODIMENTS

In preferred embodiments, the present invention provides a method of encoding a speech signal using a pitch contour codebook to efficiently encode pitch lags. In the described embodiments four pitch lags can be encoded in one pitch contour. A pitch contour index and an average pitch lag can be encoded with approximately 8 and 4 bits.

Figures 3, 4:
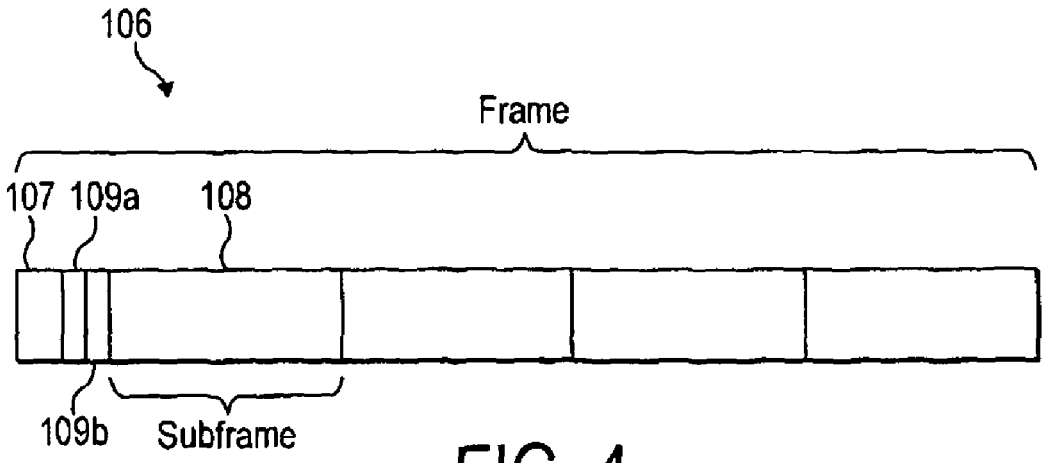
FIG. 3 is a schematic representation of a codebook for pitch contours.
FIG. 4 is another schematic representation of a frame.

FIG. 3 shows a pitch contour codebook 302. The pitch contour codebook 302 comprises a plurality M (32 in the preferred embodiment) pitch contours each represented by a respective index. Each contour comprises a four-dimensional codebook vector containing an offset for the pitch lag in each subframe relative to an average pitch lag. The offsets are denoted $O_{x,y}$ in FIG. 3, where x denotes the index of the pitch contour vector and y denotes the subframe to which the offset is applicable. The pitch contours in the pitch contour codebook represent typical evolutions over the duration of a frame of pitch lags in natural speech.

As explained more fully in the following, the pitch contour vector index is encoded and transmitted to the decoder with a coded LTB residual, where they are used to construct the speech output signal. A simple encoding of the pitch contour vector index requires 5 bits. Since some of the pitch contours occur more frequently than others, an entropy coding of the pitch contour index reduces the rate to approximately 4 bits on average.

Not only does the use of a pitch contour codebook allow for an efficient encoding of four pitch lags, but the pitch analysis is forced to find pitch lags that can be represented by one of the vectors in the pitch contour codebook. Since the pitch contour codebook contains only vectors corresponding to pitch evolutions in natural speech, the pitch analysis is prevented from finding a set of unnatural pitch lags. This has the advantage that the reconstructed speech signals sound more natural.

Figure 1A:
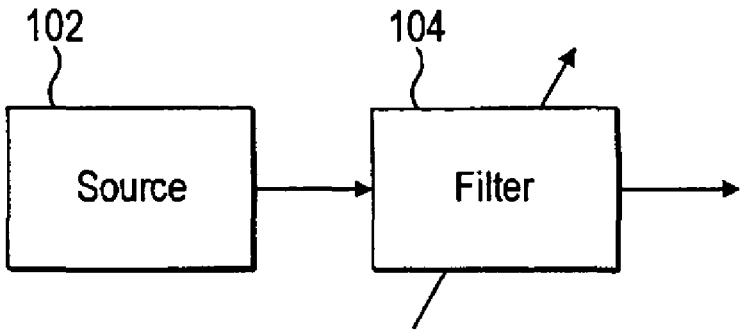
FIG. 1*a* is a schematic representation of a source-filter model of speech.
Figure 1B:
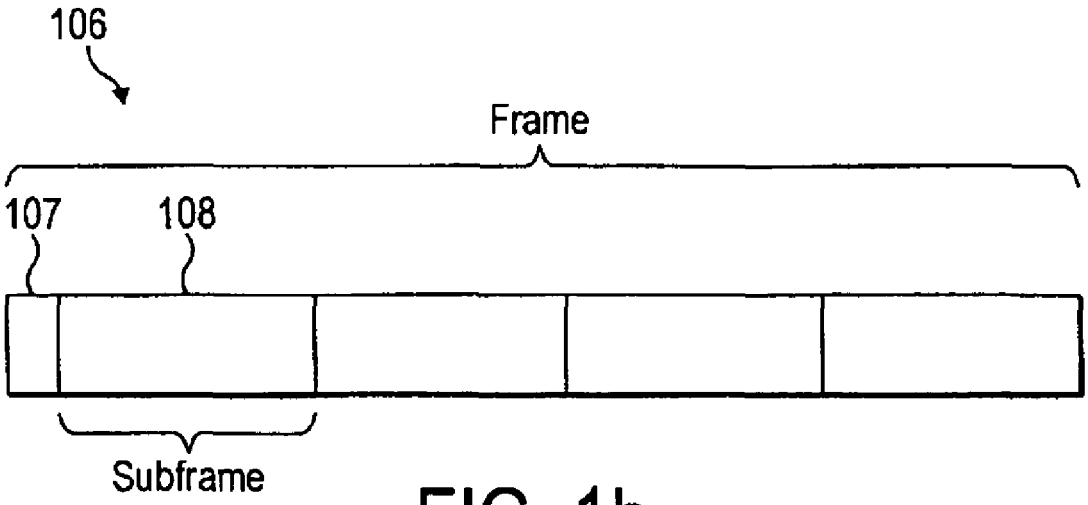
FIG. 1*b* is a schematic representation of a frame.
Figure 2A:
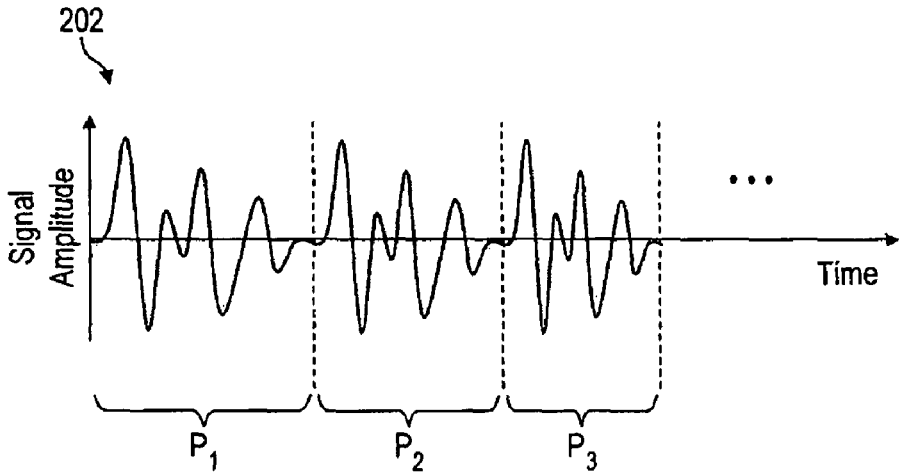
FIG. 2*a* is a schematic representation of a source signal.
Figure 2B:
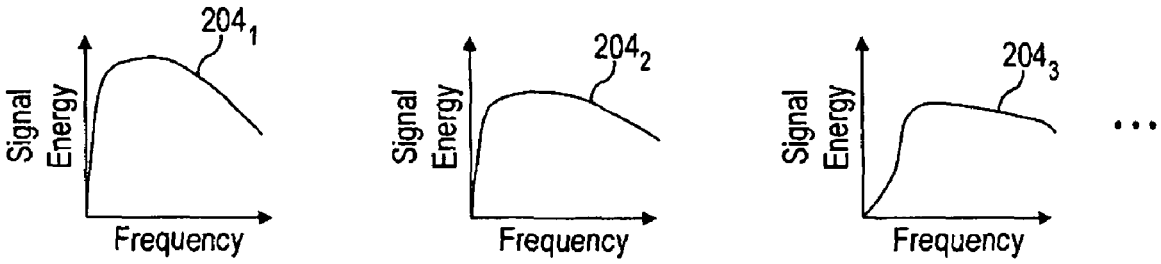
FIG. 2*b* is a schematic representation of variations in a spectral envelope.

FIG. 4 is a schematic representation of a frame according to a preferred embodiment of the present invention. In addition to the classification flag 107 and subframes 108 as discussed in relation to FIG. 1*b*, the frame additionally comprises an indicator 109*a* of the pitch contour vector, and the average pitch lag 109*b*.

Figure 5A:
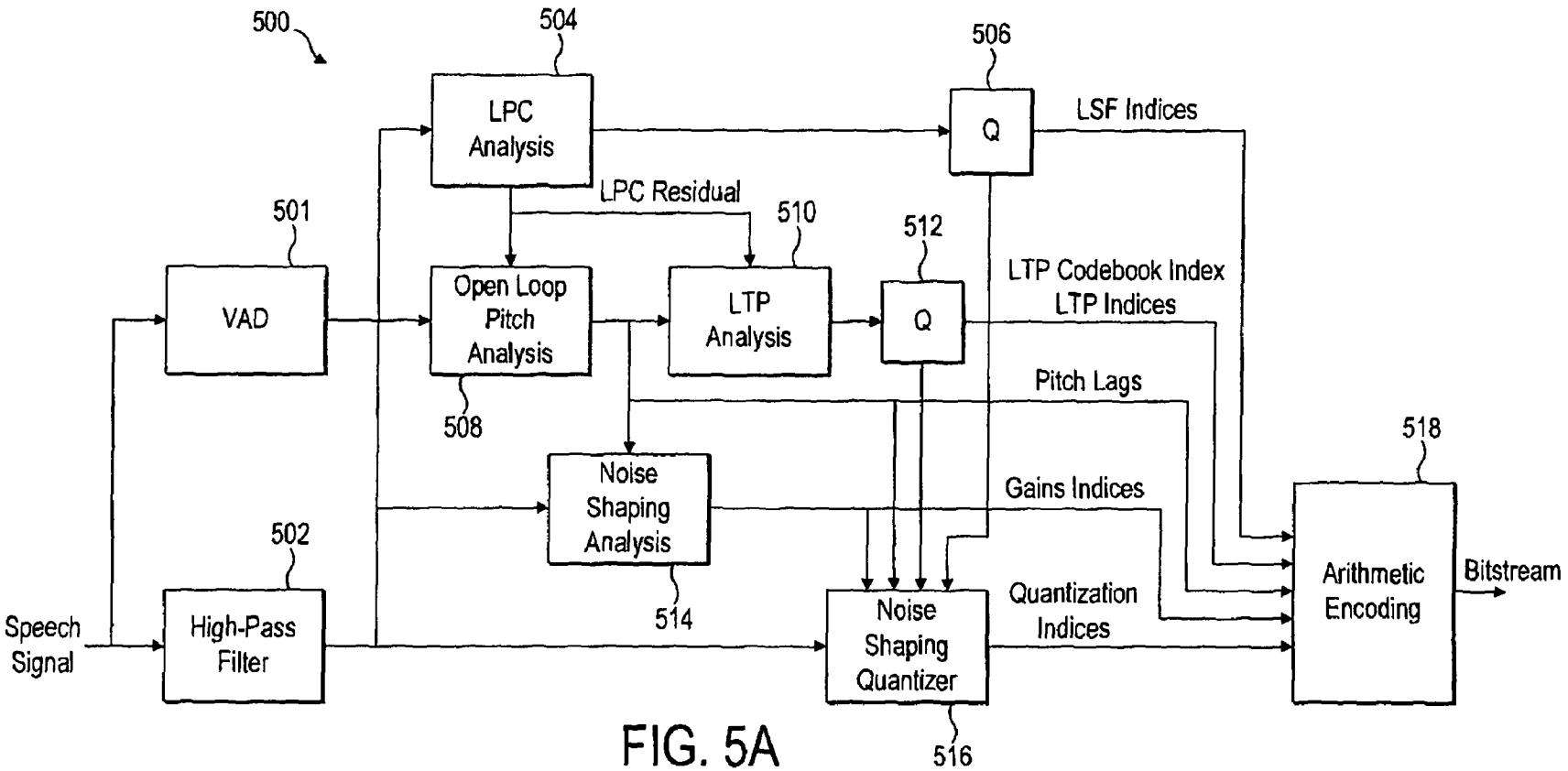
FIG. 5A is a schematic block diagram of an encoder.
Figure 5B:
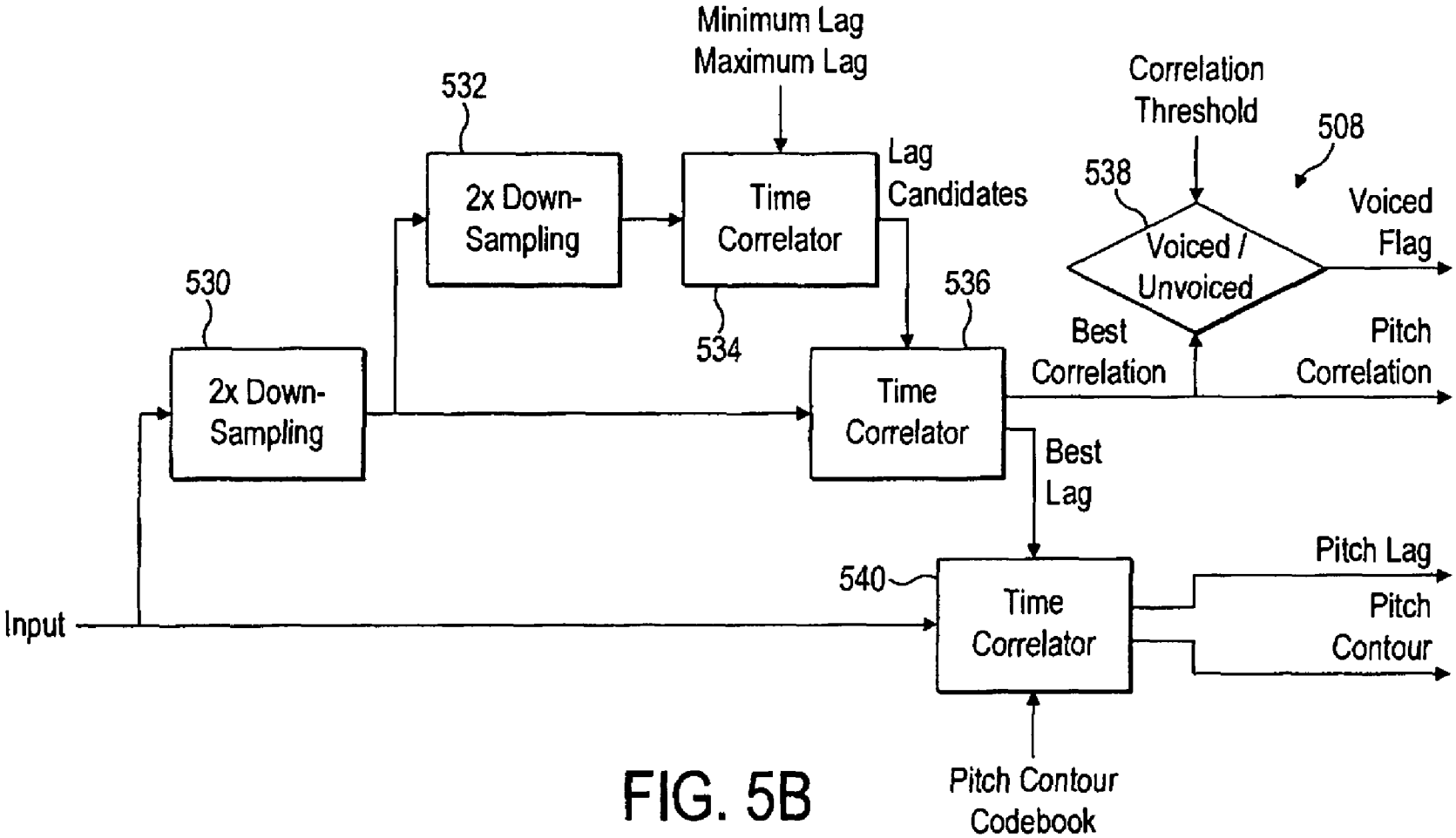
FIG. 5B is a schematic block diagram of a pitch analysis block.

An example of an encoder 500 for implementing the present invention is now described in relation to FIG. 5.

The speech input signal is input to a voice activity detector 501. The voice activity detector is arranged to determine a measure of voicing activity, and spectral tilt and signal to noise estimate, for each frame. The voice activity detector uses a sequence of half-band filter banks to split the signal into four sub-bands:

0-Fs/16, Fs/16-Fs/8, Fs/8-Fs/4, Fs/4-Fs/2, where Fs is the sampling frequency (16 or 24 kHz). The lowest subband, from 0-Fs/16 is high-pass filtered with a first-order MA filter ($H(z)=1-z^{-1}$) to remove the lowest frequencies. For each frame, the signal energy per subband is computed. In each subband, a noise level estimator measures the background noise level and an SNR (Signal-to-Noise Ratio) value is computed as the logarithm of the ratio of energy to noise level. Using these intermediate variables, the following parameters are calculated:

- Speech Activity Level between 0 and 1—Based on the Average SNR and a weighted average of the subband energies.
- Spectral Tilt between −1 and 1—Based on weighted average of the subband SNRs, with positive weights for the low subbands and negative weights for the high subbands. A positive spectral tilt indicates that most energy sits at lower frequencies.

The encoder 500 further comprises a high-pass filter 502, a linear predictive coding (LPC) analysis block 504, a first vector quantizer 506, an open-loop pitch analysis block 508, a long-term prediction (LTP) analysis block 510, a second vector quantizer 512, a noise shaping analysis block 514, a noise shaping quantizer 516, and an arithmetic encoding block 518. The high pass filter 502 has an input arranged to receive an input speech signal from an input device such as a microphone, and an output coupled to inputs of the LPC analysis block 504, noise shaping analysis block 514 and noise shaping quantizer 516. The LPC analysis block has an output coupled to an input of the first vector quantizer 506, and the first vector quantizer 506 has outputs coupled to inputs of the arithmetic encoding block 518 and noise shaping quantizer 516. The LPC analysis block 504 has outputs coupled to inputs of the open-loop pitch analysis block 508 and the LTP analysis block 510. The LTP analysis block 510 has an output coupled to an input of the second vector quantizer 512, and the second vector quantizer 512 has outputs coupled to inputs of the arithmetic encoding block 518 and noise shaping quantizer 516. The open-loop pitch analysis block 508 has outputs coupled to inputs of the LTP 510 analysis block 510 and the noise shaping analysis block 514. The noise shaping analysis block 514 has outputs coupled to inputs of the arithmetic encoding block 518 and the noise shaping quantizer 516. The noise shaping quantizer 516 has an output coupled to an input of the arithmetic encoding block 518. The arithmetic encoding block 518 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes of 5 milliseconds. The output bitstream payload contains arithmetically encoded parameters, and has a bitrate that varies depending on a quality setting provided to the encoder and on the complexity and perceptual importance of the input signal.

The speech input signal is input to the high-pass filter 504 to remove frequencies below 80 Hz which contain almost no speech energy and may contain noise that can be detrimental to the coding efficiency and cause artifacts in the decoded output signal. The high-pass filter 504 is preferably a second order auto-regressive moving average (ARMA) filter.

The high-pass filtered input $x_{HP}$ is input to the linear prediction coding (LPC) analysis block 504, which calculates 16 LPC coefficients $a_i$ using the covariance method which minimizes the energy of the LPC residual $r_{LPC}$:

$$r_{LPC}(n) = x_{HP}(n) - \sum_{i=1}^{16} x_{HP}(n-i)a_i,$$

where n is the sample number. The LPC coefficients are used with an LPC analysis filter to create the LPC residual.

The LPC coefficients are transformed to a line spectral frequency (LSF) vector. The LSFs are quantized using the first vector quantizer 506, a multi-stage vector quantizer (MSVQ) with 10 stages, producing 10 LSF indices that together represent the quantized LSFs. The quantized LSFs are transformed back to produce the quantized LPC coefficients for use in the noise shaping quantizer 516.

The LPC residual is input to the open loop pitch analysis block 508. This is described further below with reference to FIG. 5B. The pitch analysis block 508 is arranged to determine a binary voiced/unvoiced classification for each frame.

For frames classified as voiced, the pitch analysis block is arranged to determine: four pitch lags per frame—one for each 5 ms subframe—and a pitch correlation indicating the periodicity of the signal.

The LPC residual signal is analyzed to find pitch lags for which time correlation is high. The analysis consists of the following three stages.

Stage 1: The LPC residual signal is input into a first down sampling block 530 where it is twice down sampled. The twice down sampled signal is then input into a second down sampling block 532 where it is again twice down sampled. The output from the second down sampling block 532 is therefore the LPC residual signal down sampled 4 times.

The down sampled signal output from the second down sampling block 532 is input into a first time correlator block 534. The first time correlator block is arranged to correlate the current frame of the down sampled signal to a signal delayed by a range of lags, starting from a shortest lag of 32 samples corresponding to 500 Hz, to a longest lag of 288 samples corresponding to 56 Hz.

All correlation values are computed in a normalized manner according to $$C(l) = \frac{\sum_{n=0}^{N-1} x(n)x(n-l)}{\left(\sum_{n=0}^{N-1} x(n)^2 \sum_{n=0}^{N-1} x(n-l)^2\right)^{0.5}},$$

where l is the lag, x(n) is the LPC residual signal, downsampled in the first two stages, and N is the frame length, or, in the last stage, the subframe length.

It can be shown that the pitch lag with maximum correlation value leads to a minimum residual energy for a single-tap predictor, where the residual energy is defined by $$E(l) = \sum_{n=0}^{N-1} x(n)^2 - \frac{\left(\sum_{n=0}^{N-1} x(n)x(n-l)\right)^2}{\sum_{n=0}^{N-1} x(n-l)^2}$$

Stage 2: The down sampled signal output from the first down sampling block 530, is input into a second time correlator block 536. The second time correlator block 536 also receives lag candidates from the first time correlator block. The lag candidates are a list of lag values for which the correlations are (1) are above a threshold correlation and (2) above a multiple between 0 and 1 of the maximum correlation found over all lags. The lag candidates produced by the first stage are multiplied by 2 to compensate for the additional downsampling of the input signal to the first stage.

The second time correlator block 536 is arranged to measure time correlations for the lags that had sufficiently high correlations in the first stage. The resulting correlations are adjusted for a small bias towards short lags to avoid ending up with a multiple of the true pitch lag.

The lag having the highest adjusted correlation value is output from the second time correlator block 536 and input into a comparator block 538. The unadjusted correlation value for this lag is compared to a threshold value. The threshold value is computed using the formula, thr=0.45−0.1SA+0.15PV+0.1Tilt, where SA is the Speech Activity between 0 and 1 from the VAD, PV is a Previous Voiced flag: 0 if the previous frame was unvoiced and 1 if it was voiced, and Tilt is the Spectral Tilt parameter between −1 and 1 from the VAD. The threshold formula is chosen such that a frame is more likely to be classified as voiced if the input signal contains active speech, the previous frame was voiced or the input signal has most energy at lower frequencies. As all of these are typically true for a voiced frame, this leads to more reliable voicing classification.

If the lag exceeds the threshold value the current frame is classified as voiced and the lag with the highest adjusted correlation is stored for a final pitch analysis in the third stage.

Stage 3: The LPC residual signal output from the LPC analysis block is input into the third time correlator 540. The third time correlator also receives the lag (best lag) with the highest adjusted correlation determined by the second time correlator.

The third time correlator 540 is arranged to determine an average lag and a pitch contour that together specify a pitch lag for every subframe. To find the average lag, a narrow range of average lag candidates is searched for lag values of −4 to +4 samples around the lag with highest correlation from the second stage. For every average lag candidate, a codebook 302 of pitch contours is searched, where each pitch contour codebook vector contains four pitch lag offsets O, one for each subframe, with values between −10 and +10 samples. For each average lag candidate and each pitch contour vector, four subframe lags are computed by adding the average lag candidate value to the four pitch lag offsets from the pitch contour vector. For these four subframe lags, four subframe correlation values are computed and averaged to obtain a frame correlation value. The combination of average lag candidate and pitch contour vector with highest frame correlation value constitutes the final result of the pitch lag estimator.

In pseudo code this can be described as:

```
Given lag__init as the lag from stage 2 with highest correlation:
init: max__cor = −1;
For each lag__candidate = lag__init − 4 ... lag__init + 4:
  For each pitch__contour__candidate in the pitch contour codebook:
    For each subframe__index = 0...3
      subframe__lag = lag__candidate + pitch__contour__candidate[
      subframe__index ];
      correlations[ subframe__index ] = { insert correlation equation, or say
"compute correlation"? }
    end
    average__correlation = sum( correlations ) / 4;
    if average__correlation > max__cor
      best__lag = lag__candidate;
      best__pitch__contour = pitch__contour__candidate;
    end
  end
end
```

For voiced frames, a long-term prediction analysis is performed on the LPC residual. The LPC residual $r_{LPC}$ is supplied from the LPC analysis block 504 to the LTP analysis block 510. For each subframe, the LTP analysis block 510 solves normal equations to find 5 linear prediction filter coefficients $b_i$ such that the energy in the LTP residual $r_{LTP}$ for that subframe:

$$r_{LTP}(n) = r_{LPC}(n) - \sum_{i=-2}^{2} r_{LPC}(n - lag - i)b_i$$

is minimized.

The LTP coefficients for each frame are quantized using a vector quantizer (VQ). The resulting VQ codebook index is input to the arithmetic coder, and the quantized LTP coefficients are input to the noise shaping quantizer.

The high-pass filtered input is analyzed by the noise shaping analysis block 514 to find filter coefficients and quantization gains used in the noise shaping quantizer. The filter coefficients determine the distribution over the quantization noise over the spectrum, and are chosen such that the quantization is least audible. The quantization gains determine the step size of the residual quantizer and as such govern the balance between bitrate and quantization noise level.

All noise shaping parameters are computed and applied per subframe of 5 milliseconds. First, a $16^{th}$ order noise shaping LPC analysis is performed on a windowed signal block of 16 milliseconds. The signal block has a look-ahead of 5 milliseconds relative to the current subframe, and the window is an asymmetric sine window. The noise shaping LPC analysis is done with the autocorrelation method. The quantization gain is found as the square-root of the residual energy from the noise shaping LPC analysis, multiplied by a constant to set the average bitrate to the desired level. For voiced frames, the quantization gain is further multiplied by 0.5 times the inverse of the pitch correlation determined by the pitch analyses, to reduce the level of quantization noise which is more easily audible for voiced signals. The quantization gain for each subframe is quantized, and the quantization indices are input to the arithmetically encoder 518. The quantized quantization gains are input to the noise shaping quantizer 516.

Next a set of short-term noise shaping coefficients $a_{shape,\,i}$ are found by applying bandwidth expansion to the coefficients found in the noise shaping LPC analysis. This bandwidth expansion moves the roots of the noise shaping LPC polynomial towards the origin, according to the formula:

$$a_{shape,i}=a_{autocorr,i}g^i$$

where $a_{autocorr,i}$ is the ith coefficient from the noise shaping LPC analysis and for the bandwidth expansion factor g a value of 0.94 was found to give good results.

For voiced frames, the noise shaping quantizer also applies long-term noise shaping. It uses three filter taps, described by:

$$b_{shape}=0.5\text{sqrt(PitchCorrelation)}[0.25,0.5,0.25].$$

The short-term and long-term noise shaping coefficients are input to the noise shaping quantizer 516. The high-pass filtered input is also input to the noise shaping quantizer 516.

Figure 6:
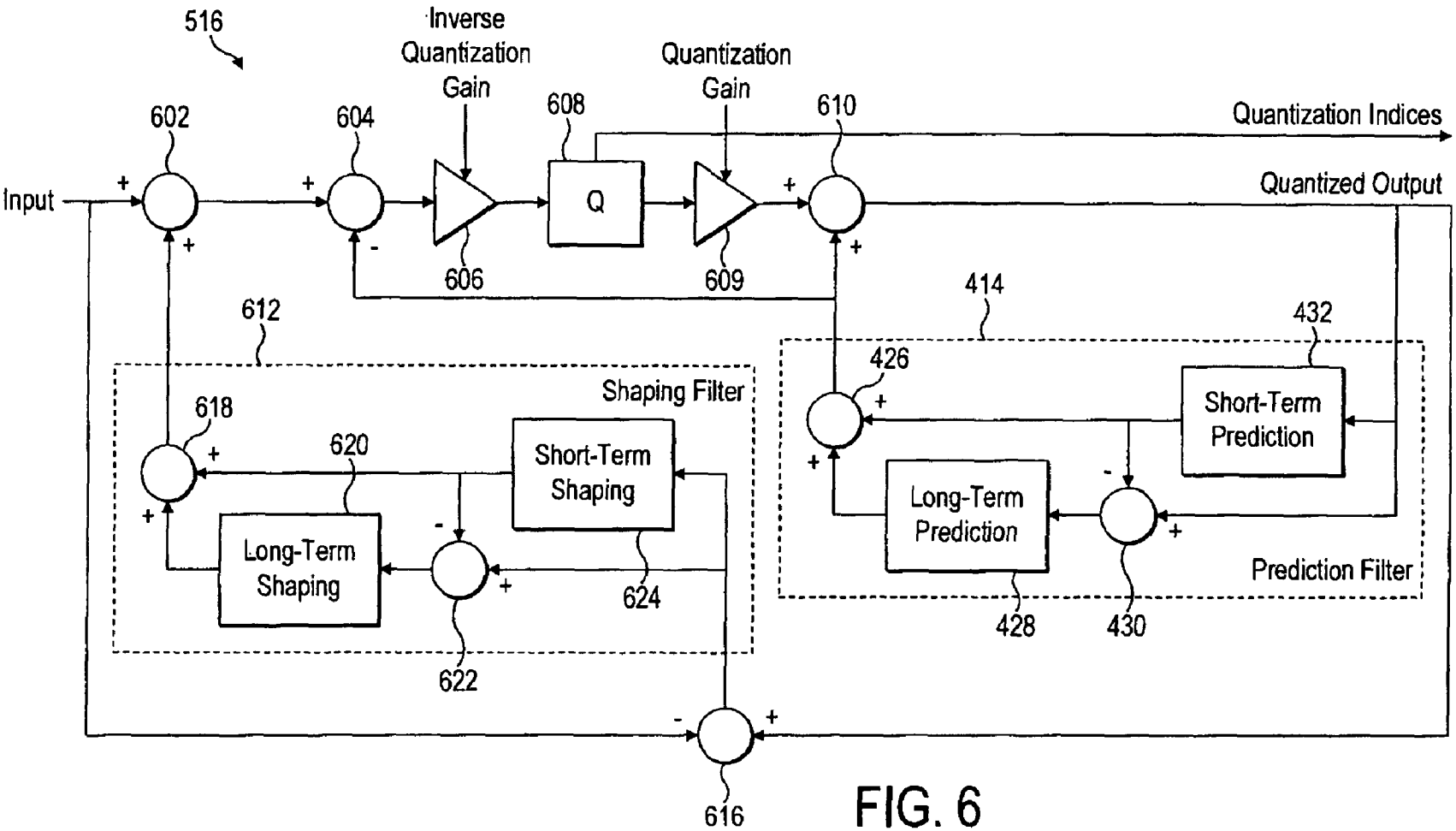
FIG. 6 is a schematic block diagram of a noise shaping quantizer.

An example of the noise shaping quantizer 516 is now discussed in relation to FIG. 6.

The noise shaping quantizer 516 comprises a first addition stage 602, a first subtraction stage 604, a first amplifier 606, a scalar quantizer 608, a second amplifier 609, a second addition stage 610, a shaping filter 612, a prediction filter 614 and a second subtraction stage 616. The shaping filter 612 comprises a third addition stage 618, a long-term shaping block 620, a third subtraction stage 622, and a short-term shaping block 624. The prediction filter 614 comprises a fourth addition stage 626, a long-term prediction block 628, a fourth subtraction stage 630, and a short-term prediction block 632.

The first addition stage 602 has an input arranged to receive the high-pass filtered input from the high-pass filter 502, and another input coupled to an output of the third addition stage 618. The first subtraction stage has inputs coupled to outputs of the first addition stage 602 and fourth addition stage 626. The first amplifier has a signal input coupled to an output of the first subtraction stage and an output coupled to an input of the scalar quantizer 608. The first amplifier 606 also has a control input coupled to the output of the noise shaping analysis block 514. The scalar quantiser 608 has outputs coupled to inputs of the second amplifier 609 and the arithmetic encoding block 518. The second amplifier 609 also has a control input coupled to the output of the noise shaping analysis block 514, and an output coupled to the an input of the second addition stage 610. Ahe other input of the second addition stage 610 is coupled to an output of the fourth addition stage 626. An output of the second addition stage is coupled back to the input of the first addition stage 602, and to an input of the short-term prediction block 632 and the fourth subtraction stage 630. An output of the short-term prediction block 632 is coupled to the other input of the fourth subtraction stage 630. The fourth addition stage 626 has inputs coupled to outputs of the long-term prediction block 628 and short-term prediction block 632. The output of the second addition stage 610 is further coupled to an input of the second subtraction stage 616, and the other input of the second subtraction stage 616 is coupled to the input from the high-pass filter 502. An output of the second subtraction stage 616 is coupled to inputs of the short-term shaping block 624 and the third subtraction stage 622. An output of the short-term shaping block 624 is coupled to the other input of the third subtraction stage 622. The third addition stage 618 has inputs coupled to outputs of the long-term shaping block 620 and short-term prediction block 624.

The purpose of the noise shaping quantizer 516 is to quantize the LTP residual signal in a manner that weights the distortion noise created by the quantisation into parts of the frequency spectrum where the human ear is more tolerant to noise.

In operation, all gains and filter coefficients and gains are updated for every subframe, except for the LPC coefficients, which are updated once per frame. The noise shaping quantizer 516 generates a quantized output signal that is identical to the output signal ultimately generated in the decoder. The input signal is subtracted from this quantized output signal at the second subtraction stage 616 to obtain the quantization error signal d(n). The quantization error signal is input to a shaping filter 612, described in detail later. The output of the shaping filter 612 is added to the input signal at the first addition stage 602 in order to effect the spectral shaping of the quantization noise. From the resulting signal, the output of the prediction filter 614, described in detail below, is subtracted at the first subtraction stage 604 to create a residual signal. The residual signal is multiplied at the first amplifier 606 by the inverse quantized quantization gain from the noise shaping analysis block 514, and input to the scalar quantizer 608. The quantization indices of the scalar quantizer 608 represent an excitation signal that is input to the arithmetically encoder 518. The scalar quantizer 608 also outputs a quantization signal, which is multiplied at the second amplifier 609 by the quantized quantization gain from the noise shaping analysis block 514 to create an excitation signal. The output of the prediction filter 614 is added at the second addition stage to the excitation signal to form the quantized output signal. The quantized output signal is input to the prediction filter 614.

On a point of terminology, note that there is a small difference between the terms "residual" and "excitation". A residual is obtained by subtracting a prediction from the input speech signal. An excitation is based on only the quantizer output. Often, the residual is simply the quantizer input and the excitation is its output.

The shaping filter 612 inputs the quantization error signal d(n) to a short-term shaping filter 624, which uses the short-term shaping coefficients $a_{shape,i}$ to create a short-term shaping signal $s_{short}(n)$, according to the formula:

$$s_{short}(n)=\sum_{i=1}^{16} d(n-i)a_{shape,i}.$$

The short-term shaping signal is subtracted at the third addition stage 622 from the quantization error signal to create a shaping residual signal f(n). The shaping residual signal is input to a long-term shaping filter 620 which uses the long-term shaping coefficients $b_{shape,i}$ to create a long-term shaping signal $s_{long}(n)$, according to the formula:

$$s_{long}(n)=\sum_{i=-2}^{2} f(n-lag-i)b_{shape,i}.$$

where "lag" is measured as a number of samples.

The short-term and long-term shaping signals are added together at the third addition stage 618 to create the shaping filter output signal.

The prediction filter 614 inputs the quantized output signal y(n) to a short-term prediction filter 632, which uses the quantized LPC coefficients $a_i$ to create a short-term prediction signal $p_{short}(n)$, according to the formula:

$$p_{short}(n)=\sum_{i=1}^{16} y(n-i)a_i.$$

The short-term prediction signal is subtracted at the fourth subtraction stage 630 from the quantized output signal to create an LPC excitation signal $e_{LPC}(n)$. The LPC excitation signal is input to a long-term prediction filter 628 which uses the quantized long-term prediction coefficients $b_i$ to create a long-term prediction signal $p_{long}(n)$, according to the formula:

$$p_{long}(n) = \sum_{i=-2}^{2} e_{LPC}(n - lag - i)b_i.$$

The short-term and long-term prediction signals are added together at the fourth addition stage 626 to create the prediction filter output signal.

The LSF indices, LTP indices, quantization gains indices, pitch lags and excitation quantization indices are each arithmetically encoded and multiplexed by the arithmetic encoder 518 to create the payload bitstream. The arithmetic encoder 518 uses a look-up table with probability values for each index. The look-up tables are created by running a database of speech training signals and measuring frequencies of each of the index values. The frequencies are translated into probabilities through a normalization step.

Figure 7:
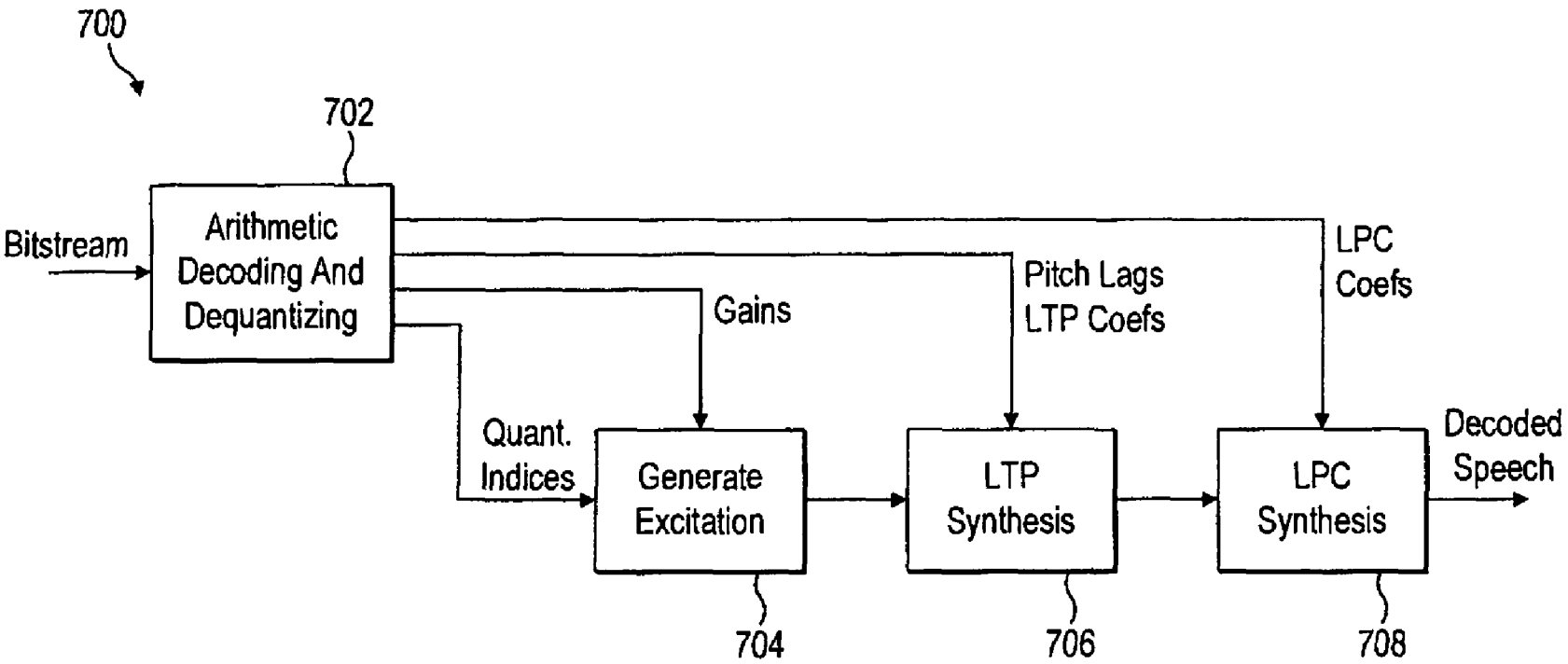
FIG. 7 is a schematic block diagram of a decoder.

An example decoder 700 for use in decoding a signal encoded according to embodiments of the present invention is now described in relation to FIG. 7.

The decoder 700 comprises an arithmetic decoding and dequantizing block 702, an excitation generation block 704, an LTP synthesis filter 706, and an LPC synthesis filter 708. The arithmetic decoding and dequantizing block 702 has an input arranged to receive an encoded bitstream from an input device such as a wired modem or wireless transceiver, and has outputs coupled to inputs of each of the excitation generation block 704, LTP synthesis filter 706 and LPC synthesis filter 708. The excitation generation block 704 has an output coupled to an input of the LTP synthesis filter 706, and the LTP synthesis block 706 has an output connected to an input of the LPC synthesis filter 708. The LPC synthesis filter has an output arranged to provide a decoded output for supply to an output device such as a speaker or headphones.

At the arithmetic decoding and dequantizing block 702, the arithmetically encoded bitstream is demultiplexed and decoded to create LSF indices, LTP indices, quantization gains indices, average pitch lag, pitch contour codebook index, and a pulses signal.

The four subframe pitch lags are obtained by, for each subframe, adding the corresponding offset from the pitch contour codebook vector indicated by the pitch contour codebook index to the average pitch lag.

The LSF indices are converted to quantized LSFs by adding the codebook vectors of the ten stages of the MSVQ. The quantized LSFs are transformed to quantized LPC coefficients. The LTP indices and gains indices are converted to quantized LTP coefficients and quantization gains, through look ups in the quantization codebooks.

At the excitation generation block, the excitation quantization indices signal is multiplied by the quantization gain to create an excitation signal e(n).

The excitation signal is input to the LTP synthesis filter 706 to create the LPC excitation signal $e_{LPC}(n)$ according to:

$$e_{LPC}(n) = e(n) + \sum_{i=-2}^{2} e(n - lag - i)b_i,$$

using the pitch lag and quantized LTP coefficients $b_i$.

The LPC excitation signal is input to the LPC synthesis filter to create the decoded speech signal y(n) according to:

$$y(n) = e_{LPC}(n) + \sum_{i=1}^{16} e_{LPC}(n - i)a_i,$$

using the quantized LPC coefficients $a_i$.

The encoder 500 and decoder 700 are preferably implemented in software, such that each of the components 502 to 632 and 702 to 708 comprise modules of software stored on one or more memory devices and executed on a processor. A preferred application of the present invention is to encode speech for transmission over a packet-based network such as the Internet, preferably using a peer-to-peer (P2P) network implemented over the Internet, for example as part of a live call such as a Voice over IP (VoIP) call. In this case, the encoder 500 and decoder 700 are preferably implemented in client application software executed on end-user terminals of two users communicating over the P2P network.

It will be appreciated that the above embodiments are described only by way of example. Other applications and configurations may be apparent to the person skilled in the art given the disclosure herein. The scope of the invention is not limited by the described embodiments, but only by the following claims.

The invention claimed is:

1. A method of encoding speech, the method comprising receiving a signal representative of speech to be encoded;

at each of a plurality of intervals during encoding of the speech, determining a pitch lag between portions of the signal having a degree of repetition;

selecting for a set of said intervals a pitch lag vector from a pitch lag codebook of such vectors, each pitch lag vector comprising a set of offsets corresponding to the offset between the pitch lag determined for each said interval and an average pitch lag for said set of intervals, and transmitting an indication of the selected vector and said average over a transmission medium as part of the encoded signal representative of said speech.

2. The method of claim 1, wherein the encoding is performed over a plurality of frames, each frame comprising a plurality of subframes, each of said intervals is a subframe, and the set comprises the number of subframes per frame such that said selection and transmission are performed once per frame.

3. A method according to claim 2, wherein there are four subframes per frame, and each pitch lag vector comprises four offsets.

4. A method according to claim 1, wherein the pitch lag codebook comprises 32 pitch lag vectors.

5. A method according to claim 1, wherein the step of determining a pitch lag comprises determining a correlation between portions of the signal having a degree of repetition, and determining a maximum correlation value for a plurality of pitch lags.

6. A method according to claim 2, comprising the step of determining for each frame whether the frame is voiced or unvoiced, and transmitting an indication of the selected pitch lag vector and said pitch lag average only for voiced frames.

7. The method of claim 1, wherein the speech is encoded according to a source filter model whereby speech is modelled to comprise a source signal filtered by a time varying filter.

8. The method of claim 7, comprising deriving from a received speech signal a spectral envelope signal representative of the time varying filter and a first remaining signal representative of the modelled source signal, wherein the signal representative of speech is the first remaining signal.

9. A method according to claim 8, wherein prior to determining the maximum correlation value the first remaining signal is downsampled.

10. The method of claim 8, comprising extracting a signal from the first remaining signal, thus leaving a second remaining signal and the method comprises transmitting parameters of the second remaining signal over the communication medium as part of said encoded signal.

11. The method of claim 10, wherein the extraction of said second remaining signal from the first remaining signal is by long term prediction filtering.

12. The method of claim 8, wherein the derivation of said first remaining signal from the speech signal is by linear predictive coding.

13. An encoder for encoding speech, the encoder comprising:

means for determining at each of a plurality of intervals during encoding of a received signal representative of speech, a pitch lag between portions of said signal having a degree of repetition;

means for selecting for a set of said intervals a pitch lag vector from a pitch lag code book of such vectors, each pitch lag vector comprising a set of offsets corresponding to the offsets between the pitch lag determined for each said interval and an average pitch lag for said set of intervals; and means for transmitting an indication of the selected vector and said average over a transmission medium as part of the encoded signal representative of said speech.

14. An encoder according to claim 13, comprising a memory storing said pitch lag codebook of pitch lag vectors.

15. An encoder according to claim 13, comprising means for encoding speech according to a source filter model whereby speech is modelled to comprise a source signal filtered by a time varying filter, the encoder comprising: means for deriving from the received signal a spectral envelope signal representative of the time varying filter and a first remaining signal representative of the modelled source signal.

16. A method of decoding an encoded signal representative of speech, the encoded signal comprising an indication of a pitch lag vector comprising a set of offsets corresponding to an offset between a pitch lag determined for each interval in said set and an average pitch lag for said set of intervals;

determining for each interval a pitch lag based on the average pitch lag for said set of intervals and each corresponding offset in the pitch lag vector identified by the indication; and using the determined pitch lags to encode other portions of a received signal representative of said speech.

17. A decoder for decoding an encoded signal representative of speech, the decoder comprising:

means for identifying from a received indication in the encoded signal a pitch lag vector from a pitch lag codebook of such vectors; and means for determining a pitch lag for each of a set of intervals from a corresponding offset in the pitch lag vector and an average pitch lag for said set of intervals, said average pitch lag being part of the encoded signal.

18. A computer program product for encoding speech, the program comprising code which when executed implements the coding method of:

receiving a signal representative of speech to be encoded;

at each of a plurality of intervals during the encoding, determining a pitch lag between portions of the signal having a degree of repetition;

selecting for a set of said intervals a pitch lag vector from a pitch lag codebook of such vectors, each pitch lag vector comprising a set of offsets corresponding to the offset between the pitch lag determined for each said interval and an average pitch lag for said set of intervals, and transmitting an indication of the selected vector and said average over a transmission medium as part of the encoded signal representative of said speech.

19. A computer program product for decoding an encoded signal representative of speech, then encoded signal comprising an indication of a pitch lag vector comprising a set of offsets corresponding to an offset between a pitch lag determined for each interval in said set and an average pitch lag for said set of intervals, the program comprising code which when executed implements the decoding method of:

determining for each interval a pitch lag based on the average pitch lag for said set of intervals and each corresponding offset in the pitch lag vector identified by the indication; and using the determined pitch lags to encode other portions of a received signal representative of said speech.

* * * * *